US006384526B1

(12) United States Patent
Peters

(10) Patent No.: US 6,384,526 B1
(45) Date of Patent: May 7, 2002

(54) FLUORESCENT TUBE WITH TWO DIAMETRICALLY SITUATED DIFFUSER LAYERS

(75) Inventor: Gunther Peters, Karlskrona (SE)

(73) Assignee: Auralight AB, Karlskrona (SE)

( * ) Notice: Subject to any disclaimer, the term of this patent is extended or adjusted under 35 U.S.C. 154(b) by 0 days.

(21) Appl. No.: 09/508,761

(22) PCT Filed: Sep. 30, 1998

(86) PCT No.: PCT/SE98/01769

§ 371 Date: Mar. 16, 2000

§ 102(e) Date: Mar. 16, 2000

(87) PCT Pub. No.: WO99/18597

PCT Pub. Date: Apr. 15, 1999

(30) Foreign Application Priority Data

Oct. 2, 1997 (SE) ..... 9703596

(51) Int. Cl.[7] ..... H01J 1/62
(52) U.S. Cl. ..... 313/493; 313/485
(58) Field of Search ..... 313/493, 485, 313/573, 577, 634, 635

(56) References Cited

U.S. PATENT DOCUMENTS 4,803,399 A 2/1989 Ogawa et al.
5,142,191 A 8/1992 Blaisdell et al.
5,688,035 A * 11/1997 Kashima et al. ..... 362/31
5,804,914 A * 9/1998 Ozawa et al. ..... 313/493

FOREIGN PATENT DOCUMENTS

JP 62-179272 A 8/1987

* cited by examiner

*Primary Examiner*—Vip Patel
*Assistant Examiner*—Ken A. Berck
(74) *Attorney, Agent, or Firm*—Nixon & Vanderhye

(57) ABSTRACT

An encapsulated fluorescent tube comprises an inner tube provided on its inside with a fluorescing substance layer, and an outer transmission tube which coaxially surrounds the inner tube. On its inside the outer tube is provided with two diffuser layers, situated diametrically opposite each other and extending in the longitudinal direction of the tube. The layers extend over a peripheral angle (α) of between 50° and 120°. The transmission factor of each layer is highest by its longitudinal edges and lowest by its center situated between tile edges. The diffuser layers are furthermore reflective with the lowest reflection factor at the edges of the layers and the highest reflection factor at the center of the layers. Extremely even light distribution can in this way be obtained in the plane parallel with the central plane (Y—Y) between the diffuser layers, for example, the sides of signs in double-sided light signs.

20 Claims, 2 Drawing Sheets

FLUORESCENT TUBE WITH TWO DIAMETRICALLY SITUATED DIFFUSER LAYERS

CROSS REFERENCE TO RELATED APPLICATION

This application is a U.S. national phase of International application no. PCT/SE98/01769 filed internationally Sep. 30, 1998.

BACKGROUND AND SUMMARY OF THE INVENTION

The present invention relates to fluorescent tubes. The inner tube is the actual fluorescent tube and is encapsulated in an outer tube. A heat insulating air layer is obtained which surrounds the inner tube. In this way, an improved light yield is obtained from it in installations in cold environment.

Fluorescent tubes of the above-mentioned type are often used for illuminated signs, especially double-sided such. These have two display sides which are arranged parallel with respect to each other with a relatively small mutual distance between them. Fluorescent tubes are arranged between the display sides, usually in the form of a group of straight, mutually parallel fluorescent tubes. In this connection it is desirable that the display sides have an as even illumination as possible in order to avoid disturbing bands of light in the appearance of the sign. In order to achieve this, the fluorescent tubes can be arranged close to each other which, however, entails high costs. A normal compromise is there-fore to arrange the fluorescent tubes with such a large mutual distance that the illumination intensity of the darkest parts of the sign sides is approx. 50% of the illumination intensity of the lightest parts.

The object of the present invention is to improve fluorescent tubes of the type mentioned in the introduction in order to be able to give the sides of the sign a more even illumination.

According to a preferred embodiment the transmission characteristics of the diffuser layer in the circumferential direction of the tube varies from a high value at the longitudinal edge parts of the diffuser layer to a low value at the centre part situated in the middle between the edge parts of the layer. Variations in the light intensity in different directions from the fluorescent tube then become less. Further improvement can be obtained if the reflective ability of the diffuser layer varies in the reverse manner to the transmission ability.

The two diametrically situated diffuser layers spread the light transmitted therethrough but also prevent the transmission of a part of the thereon incident light flux from the inner tube. At the same time each diffuser layer reflects a part of the incident light flux towards the diametrically opposite half of the outer tube. The inner tube prevents a part of this reflected light flux from reaching the other half of the tube. This screening effect is greatest at the centre part of the diffuser layer, which is favorable because it is desirable to attenuate the light intensity in this direction. In this way the light intensity will be more even in different directions from the fluorescent tube and thereby the illumination will be more even on planar surfaces, e.g. the sides of signs, arranged parallel with a central plane between the diffuser layers. For example, it has been noted that when fluorescent tubes according to the invention were mounted in a sign which with prior art fluorescent tubes gave an illumination intensity of 50% at the darkest parts compared with the lightest, at the darkest parts an illumination intensity of 80% to 90% of that of the lightest parts was obtained.

BRIEF DESCRIPTION OF THE DRAWINGS

An example of an embodiment of the invention is described below in more detail with reference to the accompanying drawing wherein.

DETAILED DESCRIPTION OF THE DRAWINGS

Figure 1:
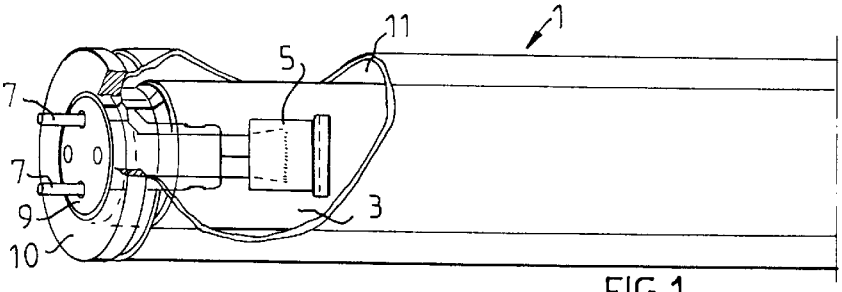
FIG. 1 is a fragmentary perspective view of one end of a known, capsulated fluorescent tube, partly sectioned.

FIG. 1 shows one end of a capsulated fluorescent tube 1 according to the prior art. This comprises an inner glass tube 3, which on the inside is coated with a fluorescing substance and forms the actual fluorescent tube. Inside the end of the inner tube 3 there is arranged an electrode 5, which is in connection with two contact pins 7, which are arranged diametrically on the end socket 9 of the tube and which project out axially from it. The inner tube 3 is coaxially surrounded by an outer glass tube 11, which with he help of silicon rings 10 is sealed to the tube at both of the end sockets 9.

Figure 2:
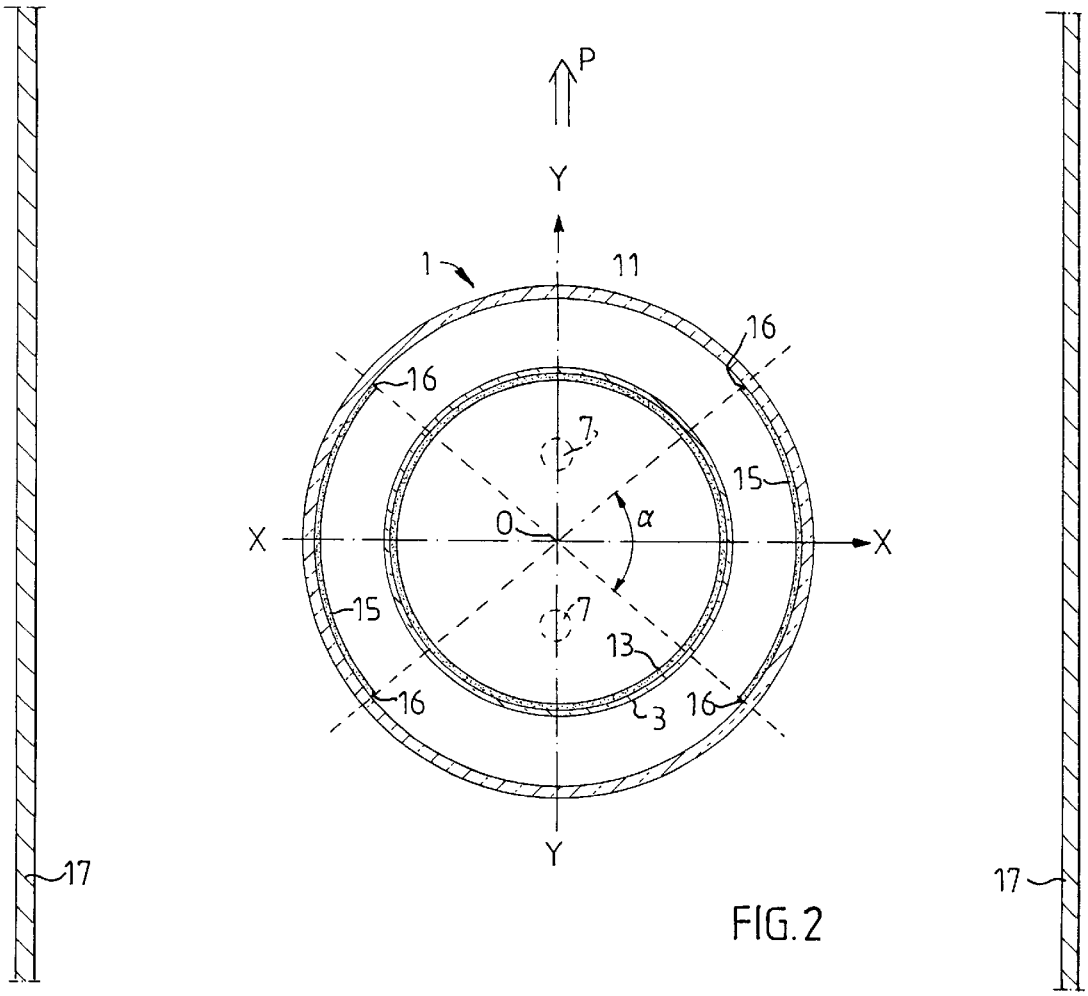
FIG. 2 is an enlarged cross-sectional view through a fluorescent tube according to a preferred embodiment of the present invention.

FIG. 2 represents a cross-section through a fluorescent tube according to the invention. The figure shows an inner glass tube 3, which on the inside is provided with a layer of a fluorescing substance 13. Coaxially surrounding the inner tube 3 is an outer glass tube 11 which, like the inner tube 3, has a circular cross-section. The electrodes 5 shown in FIG. 1 are not repeated in FIG. 2, but FIG. 2 shows with dashed lines the two contact pins 7. Normal dimensions for the tubes are an outer diameter of 26 mm for the inner tube (T8) and 38 mm for the outer tube (T12).

That which is described above in connection to FIG. 2 can also be found in the prior art fluorescent tube shown in FIG. 1. As a difference from this, the fluorescent tube according to the invention has according to FIG. 2 two diffuser layers 15, which are arranged on the inside of the outer tube 11 diametrically opposite each other. Each diffuser layer 15 extends in the circumferential direction of the tube 11 about a peripheral angle $\alpha$ seen from the centre line O of the fluorescent tube. The angle a should lie between 50° and 120° and is preferably between 75° and 85°.

FIG. 2 also shows, in section, parts of two sign sides 17 of a double-sided illuminated sign, not shown in mere detail. The sides 17 of the sign are transmittent and have, for example, advertising text or pictures. The sign sides 17 are arranged parallel with a central plane Y—Y, which extends through the centre line O of the fluorescent tube 1 and the two contact pins 7. A plane situated perpendicular to this plane through the centre line O has the reference X—X.

In the embodiment shown in FIG. 2, the two diffuser layers 15 extend along essentially the whole of the length of the outer tube 11. Furthermore, the angle $\alpha$ is the same for both diffuser layers 15 and is equally large along the whole length of the layers.

The diffuser layers 15 consist in the embodiment shown of a mixture of powdered $TiO_2$ and $BaSO_4$. A part of the amount of light which is incident from the inner tube on each diffuser layer 15 is reflected back towards the other half of the outer tube 11 situated on the opposite side of the central plane Y—Y). The reflection factor of the diffuser layer 15 is suitably between 10% and 50% of the incident light flux. A part of this reflected light flux hits the opposite diffuser layer in the other half of the tube. Other parts of the reflected light flux flow out through the outer tube 11 in those parts thereof which lie between the longitudinal edges 16 of the opposite diffuser layer 15 and the central plane Y—Y. Furthermore, the diffuser layers 15 absorb a part of the incident light flux falling on their inside. The absorption factor can vary between 10% and 30%. The remainder of the incident light flux falling on the diffuser layers from inside is transmitted as diffuse light. The intensity of this transmitted light is between 30% and 75% of the intensity P of the light which is radiated in the central plane Y—Y and which is shown by an arrow in FIG. 2. Preferably, the light intensity of the transmitted light is between 35% and 65%) of P. In the preferred embodiment, furthermore, the transmission factor of the diffuser layers 15 varies in the circumferential direction of the outer tube 11 such that the layers 15 have their lowest transmission factor at their centres, i.e. in the plane X—X, and that the transmission factor increases from these centres towards the edges 16 of the layers. In the middle of the layers 15 the intensity of the transmitted light can then amount to the above-mentioned 35% of P and at the edges of the layers to 65% of P.

The variation in the circumferential direction of the transmission factor of the diffuser layers can be achieved through the thickness of the diffuser layers 15 being varied, in the preferred embodiment from a thickness which is greatest at the centre of the plane X—X to a thickness which is smallest at the edges 16. Also the reflection factor of the layers 15 can vary through varying the thickness of the layers, whereby thicker layers give higher reflection factors. In the preferred embodiment the reflection factor is reduced from the centre of the layers 15 at the plane X—X out towards their edges 16. The reflection factor can vary between 10% and 50% of the light incident on the layer 15 from inside. Suitably the reflection factor at the centre of the layer 15 is between 30% and 50%.

Through the above described variations in the transmission and reflection factors of the diffuser layers 15 it is possible to produce an extremely even light distribution on the sides 17 of the sign illuminated by the fluorescent tube 1. In the plane X—X, where the sides of the sign are closest to the fluorescent tube, the intensity of the transmitted light is lowest and it increases with increasing distance from this plane. Through each diffuser layer acting as a reflector and throwing reflected light towards the opposite half of the fluorescent tube, the usable radiating angle of the fluorescent tube is increased.

Figure 3:
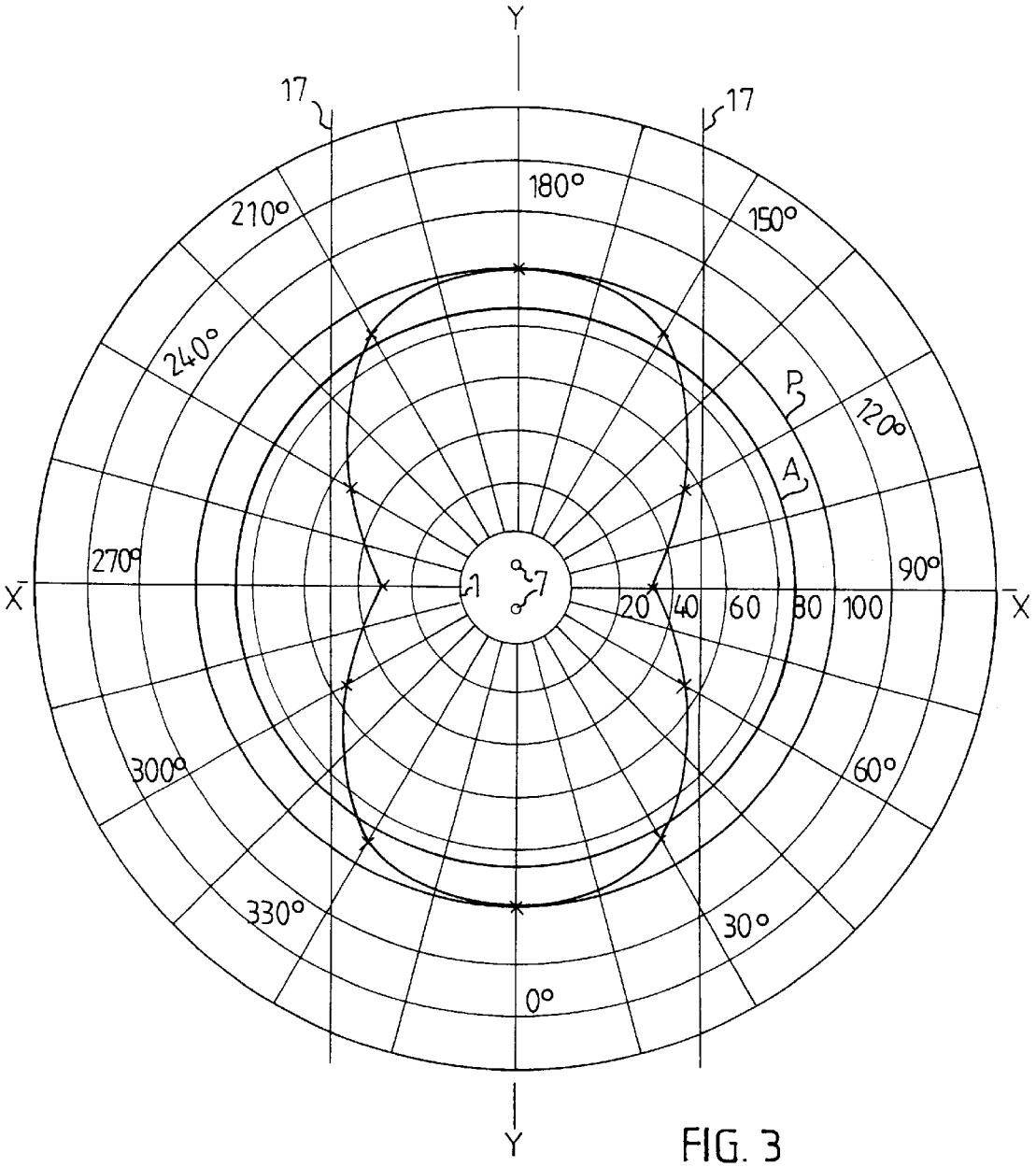
FIG. 3 is a light distribution curve for a fluorescent tube according to FIG. 2.

FIG. 3 represents a light distribution curve in the shape of a polar diagram, which shows the light intensity of the radiation from a fluorescent tube 1 according to FIG. 2. The fluorescent tube 1 is shown schematically in the centre of the diagram with the contact pins 7 lying in the Y-plane. In the Y-plane light is radiated with a light intensity which is designated 100 in the diagram and corresponds to the above-mentioned light intensity P. The diagram shows that the light intensity of the light radiated by the fluorescent tube 1 is lowest in the X-plane, i.e. at the centre parts of the diffuser layers 15, and increases with increasing angles from this. In FIG. 3 two straight lines have been drawn which are parallel with the Y-axis and schematically represent the sides 17 of the signs shown in FIG. 2. As is clear the light intensity is very even between approx. 30° and approx. 150° and between approx. 210° and approx. 330°, respectively, so that the light intensity on the sign sides becomes very even.

FIG. 3 also shows by means of the circle A the intensity of the light beams which are obtained if the outer tube 11 lacks the diffuser layers 15. The same light source as in the embodiment according to FIG. 2, the inner tube 3, in this case appeared to give rise to a light emission, tile intensity of which A was only 85% of the light intensity P, which in the embodiment of FIG. 2 was obtained in the Y-plane, i.e. in the directions where the light is not shielded by the diffuser layers. Experiments with different diffuser layers 15, where the peripheral angle a of the layers, the reflection factor and the absorption factor are varied, have shown that the light intensity P can be 10%–25% greater, compared to the light intensity A. By means of a suitable choice and combination of the shape and characteristics of the layers, a variation of between 5% and 30% can be achieved.

The circle A also shows the extremely uneven illumination intensity which would occur at the sides 17 of the sign if the outer tube 11 did not have the diffuser layer 15 or if the outer tube 11 were completely missing. A strong maximum exists in the X-plane. From the X-plane the illumination intensity falls quickly upwards and downwards. At approx. 145° and 35° as well as at 215° and 325°, respectively, the light intensity A corresponds to the light intensity P. Further away from the Y-plane the illumination intensity on the sides 17 of the sign is lower than with a fluorescent tube which is provided with diffuser layers 15 according to the invention. Consequently, with diffuser layers according to the invention a powerful reduction of the variations in the illumination intensity on the sign sides is obtained.

When large sign sides are to be illuminated, several fluorescent tubes 1 can be arranged parallel to each other in the Y-plane at such a mutual distance that where the light intensity from one tube sharply decreases, e.g. at approx. 160° and approx. 200°, respectively, the light from the adjacent fluorescent tube increases and so an even illumination intensity can be obtained, theoretically no matter how large the sides of the signs are.

What is claimed is:

1. A fluorescent tube comprising an elongated inner glass tube, the inside of which has a fluorescing substance layer, said inner glass tube including end portions having electrodes, an outer light transmitting tube coaxially surrounding the inner tube and connected thereto at said end portions, the inside of the outer tube having two diametrically opposed diffuser layers extending substantially along the entire length of said outer tube and which diffuser layers diffuse and partly reflect light radiating from the inner tube for substantial uniform illumination along opposite sides of the fluorescent tube in planes parallel with a central plane passing diametrically between the diffuser layers.

2. A fluorescent tube according to claim 1 wherein each diffuser layer in a circumferential direction of the outer tube extends over an angle $\alpha$ having an origin at the center line of the tube, wherein $\alpha$ lies between 50° and 120°.

3. A fluorescent tube according to claim 1 wherein each diffuser layer has a reflection factor which lies between 10% and 50% of the light incident thereon.

4. A fluorescent tube according to claim 3 wherein in each diffuser layer, the reflection factor varies from a lower value at longitudinal edges of the layer to a higher value along a longitudinal median between the edges of the layer.

5. A fluorescent tube according to claim 4 wherein the reflection factor at the longitudinal median of the diffuser layer is between 30% and 50%.

6. A fluorescent tube according to claim 1 wherein the intensity of the light transmitted by each diffuser layer lies between 30% and 75% of the intensity of the light radiated through the outer tube in a direction of a bisector between the two diffuser layers.

7. A fluorescent tube according to claim 1 wherein the intensity of the light transmitted from each diffuser layer varies in a circumferential direction of the tube from a higher value at longitudinal edges of the layers to a lower value along a longitudinal median between said edges of the layer.

8. A fluorescent tube according to claim 7 wherein the intensity of the light transmitted at the center of each diffuser layer is between 35% and 50% of the intensity of the light radiated through the outer tube in a direction of a bisector between the two diffuser layers.

9. A fluorescent tube according to claim 1 wherein the diffuser layers include a mixture of $TiO_2$ and $BaSO_4$.

10. A fluorescent tube according to claim 2 wherein each diffuser layer has a reflection factor which lies between 10% and 50% of the light incident thereon.

11. A fluorescent tube according to claim 3 wherein the intensity of the light transmitted by each diffuser layer lies between 30% and 75% of the intensity of the light which is radiated through the outer tube in a direction between the two diffuser layers.

12. A fluorescent tube according to claim 1 wherein the intensity of the light transmitted by each diffuser layer lies between 35% and 65% of the intensity of the light which is radiated through the outer tube in a direction between the two diffuser layers.

13. A fluorescent tube according to claim 3 wherein the intensity of the light transmitted by each diffuser layer lies between 35 and 65% of the intensity of the light which is radiated through the outer tube in a direction between the two diffuser layers.

14. A fluorescent tube according to claim 3 wherein the diffuser layers include a mixture of $TiO_2$ and $BaSO_4$.

15. A fluorescent tube according to claim 5 wherein the diffuser layers include a mixture of $TiO_2$ and $BaSO_4$.

16. A fluorescent tube according to claim 6 wherein the diffuser layers include a mixture of $TiO_2$ and $BaSO_4$.

17. A fluorescent tube according to claim 8 wherein the diffuser layers include a mixture of $TiO_2$ and $BaSO_4$.

18. A fluorescent tube according to claim 1 wherein each diffuser layer in the longitudinal direction of the outer tube extends over an angle a seen from the centerline of the tube, and wherein $\alpha$ lies between 75 and 85°.

19. A fluorescent tube according to claim 3 wherein each diffuser layer in the longitudinal direction of the outer tube extends over an angle $\alpha$ seen from the centerline of the tube, and wherein $\alpha$ lies between 75 and 85°.

20. A fluorescent tube according to claim 6 wherein each diffuser layer in the longitudinal direction of the outer tube extends over an angle $\alpha$ seen from the centerline of the tube, and wherein $\alpha$ lies between 75 and 85°.

* * * * *